United States Patent [19]

Carrington et al.

[11] Patent Number: 4,821,639

[45] Date of Patent: Apr. 18, 1989

[54] CONTROL FOR ENABLING FLIGHT TIMING OF HAMMERS DURING PRINTING

[75] Inventors: James E. Carrington, Vestal; Gerald R. Westcott, Newark Valley, both of N.Y.

[73] Assignee: International Business Machines Corporation, Armonk, N.Y.

[21] Appl. No.: 84,359

[22] Filed: Aug. 12, 1987

[51] Int. Cl.[4] ..... B41J 1/20

[52] U.S. Cl. ..... 101/93.14; 400/146; 364/519

[58] Field of Search ..... 101/93.13, 93.14, 93.29; 400/146, 153, 154, 155, 157.2, 679, 719; 364/518, 519, 900 MS File

[56] References Cited

U.S. PATENT DOCUMENTS

| | | | |
|---|---|---|---|
| 3,872,788 | 3/1975 | Palumbo | 101/93.14 |
| 4,278,021 | 7/1981 | Nakano et al. | 101/93.29 |
| 4,317,412 | 3/1982 | Bolcavage | 101/93.14 |
| 4,440,079 | 4/1984 | Dayger et al. | 400/157.3 |

OTHER PUBLICATIONS

"Flight Time System for a High Speed Printer"; J. S. Gregor et al.; *IBM Technical Disclosure Bulletin*; vol. 27, No. 4B, pp. 2318–2319; Sep. 1984.

*Primary Examiner*—David A. Wiecking
*Attorney, Agent, or Firm*—John S. Gasper

[57] ABSTRACT

A printer control apparatus provides a control circuit arrangement which enables flight timing to be performed during printing. Basically, the invention achieves this by providing flight time control means activated by a print hammer operation signal. Preferably the control temporarily inhibits the continuation of print hammer operation. Preferably the control inhibits print hammer operation subsequent to a selected print hammer by inhibiting the comparisons of print line and type element data contained in storage devices of the print control. Inhibiting may be for a fixed interval based on an average of the flight times of all the hammers. Alternatively the inhibiting interval may be varied according to the individual flight times of the hammers. In order to avoid slowing the print speed excessively, only one hammer is timed during printing of one line.

12 Claims, 5 Drawing Sheets

PRINT & FLIGHT TIME MULTIPLEXOR CONTROLS (PFTM)
HAMMER FIRE & FLIGHT TIME (HFT) CONTROL
HAMMERS
HAMMER STRIKE
ADDRESS
SET
RESET
PLM
FTM
SET FT LATCH
INITIATE FIRE
CLOCK
DATA
ADDRESS & CONTROLS
FTI
COMPARATOR
PLB
BIB
FTB
SYSTEM INTERFACE
DATA INTERFACE
PSS GEN
PSS
ADDRESS & CONTROL
SCAN
AMP

CONTROL FOR ENABLING FLIGHT TIMING OF HAMMERS DURING PRINTING

DESCRIPTION

Field Of The Invention

This invention relates to impact printing and particularly to printer control apparatus for flight timing print hammer mechanisms in an on-the-fly impact printer.

BACKGROUND OF THE INVENTION

In on-the-fly impact printers, a plurality of print hammers arranged in a row are selectively operated to effect impact of a print medium against selected characters on a moving type carrier such as an engraved type band or belt. The relative spacing of the hammers and characters differs so that characters align with and hammers are fired in accordance with the well known scan/subscan principle of operation. In general, a plurality of print scans are required to print a complete print line.

The flight time of each of the hammers is an important parameter in controlling the firing of the hammer. Because of differences in the flight times of individual hammers, the flight time of each hammer is measured and the flight time data is then used by the electronic print control for timing the firing of the hammers while printing.

Flight timing of print hammers in printers is well known. Examples of the technique are shown in U.S. Pat. Nos. 3,872,788, issued Mar. 25, 1972 and 4,440,079, issued Apr. 3, 1984; and in the IBM Technical Disclosure Bulletin of September 1984, Vol. 27, No. 4B, pp. 2318 et seq. It was customary to perform the flight timing as part of the installation of the hammers into the printer. Flight timing was also done after the printer had been operated over a substantial period of use. Heretofore, it has been necessary to interrupt printing to do the flight timing.

SUMMARY OF THE INVENTION

The electronic control apparatus of the present invention provides a control circuit arrangement which enables flight timing to be performed during printing. Basically, the invention achieves this by providing flight time control means activated by a print hammer operation signal. Preferably the control means then temporarily inhibits the continuation of print hammer operation. Preferably the control inhibits print hammer operation by inhibiting the comparisons of print line and type element data contained in storage devices of the print control. Inhibiting may be for a fixed duration based on an average of the flight times of all the hammers. Alternatively in accordance with a feature of this invention, the inhibiting interval may be varied according to the individual flight times of the hammers. While the flight timing during printing tends to slow the printing output, the flight time operation is limited to the first fired hammer in each print operation. Thus the delay imposed on the printing operation by flight timing can be distributed over a relatively long period of time so as to have negligible effect on the printing process. As a consequence, the termination of printing for the purpose of updating the flight times of all the hammers is avoided and improved performance of printers is obtained. Other advantages will become apparent from the following detailed description.

DESCRIPTION OF THE PREFERRED EMBODIMENTS

Figure 1:
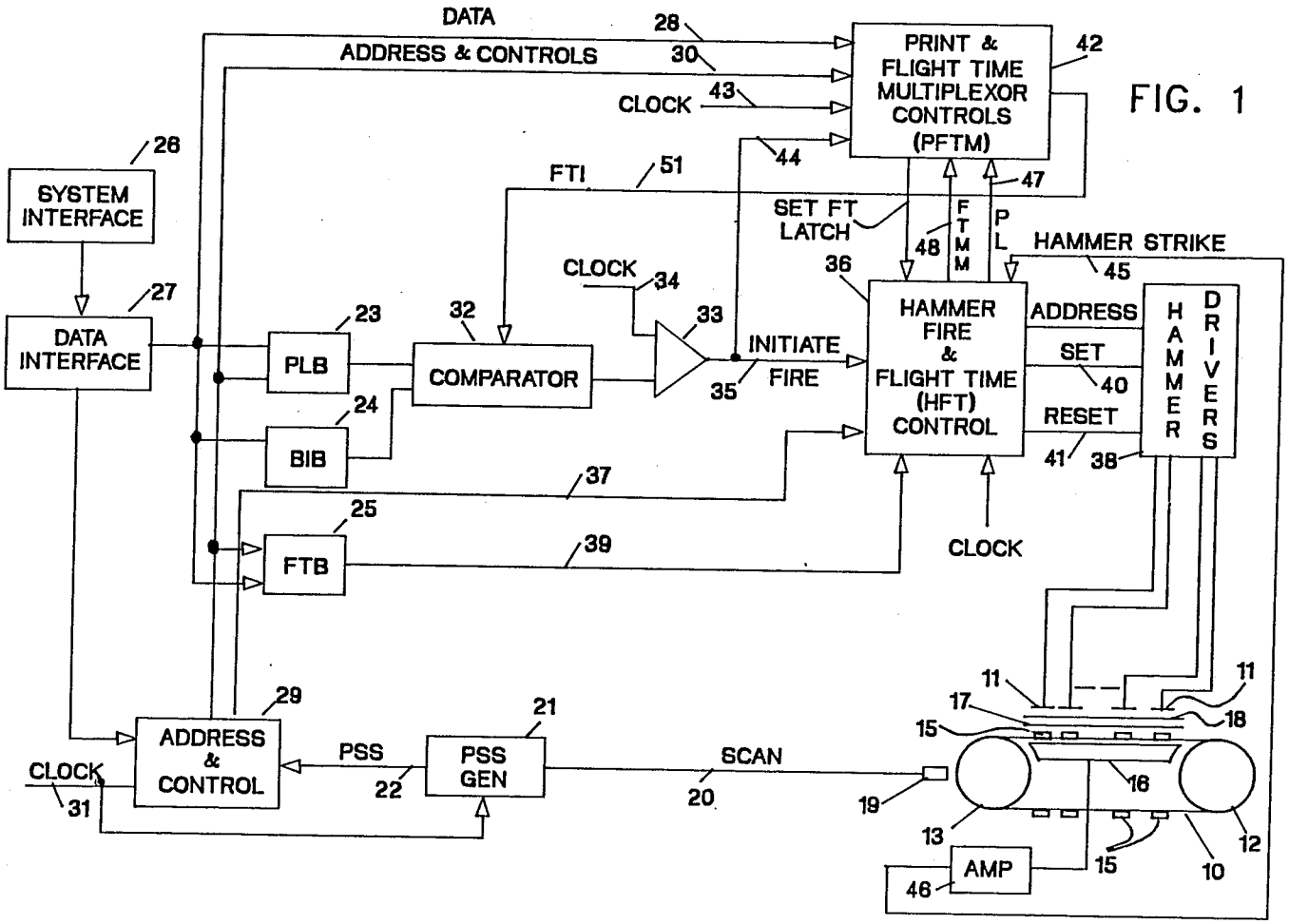
FIG. 1 is block diagram of a printer control system incorporating the invention.

As seen in FIG. 1, a suitable print mechanism for practicing the invention comprises a continuous type belt or band 10 and electromagnetically operated print hammers 11 arranged in a row parallel with a straight portion of band 10. Band 10 is supported by rotatable drive pulleys 12 and 13, one of which may be connected to a drive motor which operates to move type band 10 at a constant speed during printing. Engraved type elements 15 are uniformly spaced around band 10 but at a pitch which differs from the spacing of hammers 11. Due to the pitch differential, type elements 15 align as subgroups with subgroups of hammers 11 during band motion in accordance with the scan/subscan principle of operation. The scan/subscan principle of operation is well known and further detailed information can be obtained from U.S. Pat. No. 4,275,653, issued June 30, 1981 to R. D. Bolcavage et al.

Adjacent to one side of type band 10 between pulleys 12 and 13 is platen 16. Opposite platen 16 and adjacent to band 10 is print medium comprising ink ribbon 17 and paper 18. When selectively operated, print hammers 11 impact paper 18 and ink ribbon 17 against type elements 15 causing type band 10 to impact platen 16. For practicing this invention, hammer impacts are sensed by one or more impact transducers embedded in, attached or otherwise connected to platen 16. A platen using embedded transducers and suitable for this purpose is described in copending application of L. L. Anderson et al, serial number 925,591, filed on Oct. 31, 1986. and issued as U.S. Pat. No. 4,786,015 on Oct. 25, 1988.

In a particular arrangement in which the invention is practiced, the print mechanism can have 168 print hammers for 168 print positions of a print line spaced ten to the inch. Type band 10 may have 480 type elements 15 spaced 0.133 inches thereby providing 4 subscans per print scan. With this arrangement the complete revolution of the band 10 would break down to 480 scans. A print cycle or operation may consist of one or more print scans dependent on the number of characters to be printed in a print line.

Band 10 has timing marks (not shown), which may also be engraved, for sensing by a transducer 19 which generates scan pulses on line 20 to print subscan pulse (PSS) generator 21. There is customarily one timing mark aligned with each type character 15 so that transducer 19 produces one scan pulse each print scan. PSS generator 21 in turn produces plural PSS pulses on line 22. The number of PSS pulses corresponds to the number of subscan alignments of type elements 15 with hammers 11. For the specific spacing already discussed, PSS generator 21 produces four PSS pulses on line 22 in response to each scan pulse received on line 20 from transducer 19.

In the print control arrangement shown schematically in FIG. 1, print line buffer PLB 23, band image buffer BIB 24 and flight time delay buffer FTB 25 are read/write memory devices. PLB 23 stores the print data, preferably a line at a time, to be recorded on paper 18. PLB 23 has storage locations corresponding with the number of hammers 11. Print data is stored in PLB 23 storage locations which correspond to print positions of the hammers 11. Thus characters to be printed at given print positions are stored in correspondingly addressable storage locations of PLB 23.

BIB 24 stores type data corresponding with the type characters 15 and in the sequence they are arranged on band 10. Print, type, time delay and other data are supplied by system interface 26 through data interface 27 onto data bus 28. Data transmission can take place in any manner but preferably is serial by word and parallel by bit. Print data is transmitted to PLB 23 prior to each print operation for printing a line of data. Type element data is transmitted to BIB 24 and flight time data is transmitted to FTB 25 as part of the start up of the printer preceding any print operation. Type element data would be transmitted to BIB 24 following a replacement of type band 10 where a new set of type elements 15 is involved. Time delay data would also be transmitted to FTB 25 following completion of flight timing operations which in accordance with this invention is performable during the print operations.

Address and control 29, which comprises known logic devices, applies address and various control signals on address and control bus 30. Clock pulses on line 31 control the rate at which the address signals are generated. PSS pulses from PSS generator 21 condition address and control 29 to generate address signals according to the alignment sequences of type 15 with hammers 11. Synchronization of address signal generation by address and control 29 with the motion of type 15 is provided by scan pulses applied to line 20 by transducer 19 sensing timing marks on band 10. As previously discussed, plural PSS pulses are produced for each scan pulse, the number being dependent on the relative pitch of the type 15 and hammers 11.

The address signals generated by address and control 29 during printing include both hammer address signals and type character position signals. The method for doing this is well known and may be understood from previously mentioned references. In the course of a print operation, the address signal for each hammer 11 and the corresponding storage location in PLB 23 will be generated by address and control 29 once each scan. In the course of printing, print data is read from addressed storage locations in PLB 23 for comparison by comparator 32 with type data simultaneously read from addressed storage locations in BIB 24. When the print data and type data match, comparator 32 produces an Initiate Fire signal which is gated through AND circuit 33 by a clock pulse on line 34 and onto line 35 to hammer fire and flight time HFT control 36. Hammer address signals as well as other control signals to be described later are supplied to HFT control 36 by address and control 29 on bus 37.

HFT control 36 comprises among other things logic devices which supply SET and RESET signals for turning on addressed hammer drivers 38 for a predetermined length of time. A suitable HFT control is described in the previously mentioned U.S. Pat. No. 4,440,079. In accordance with that patent, HFT control 36 would include registers for storing time delay values received from FTB 25 on bus 39 during start up operations and used for delaying the generation of the SET signal to thereby compensate for differences in the flight times of hammers 11. HFT control 36 would also include timing means such as a counter which counts clock pulses and produces a RESET signal to determine the duration hammer drivers 38 are turned on in order to control the energy level of hammers 11. Hammer drivers 38 comprise electronic switching circuits operable in response to the SET and RESET signals from HFT 36 for connecting and then disconnecting the operating coils of addressed hammers 11 to a power source.

Figure 3A:
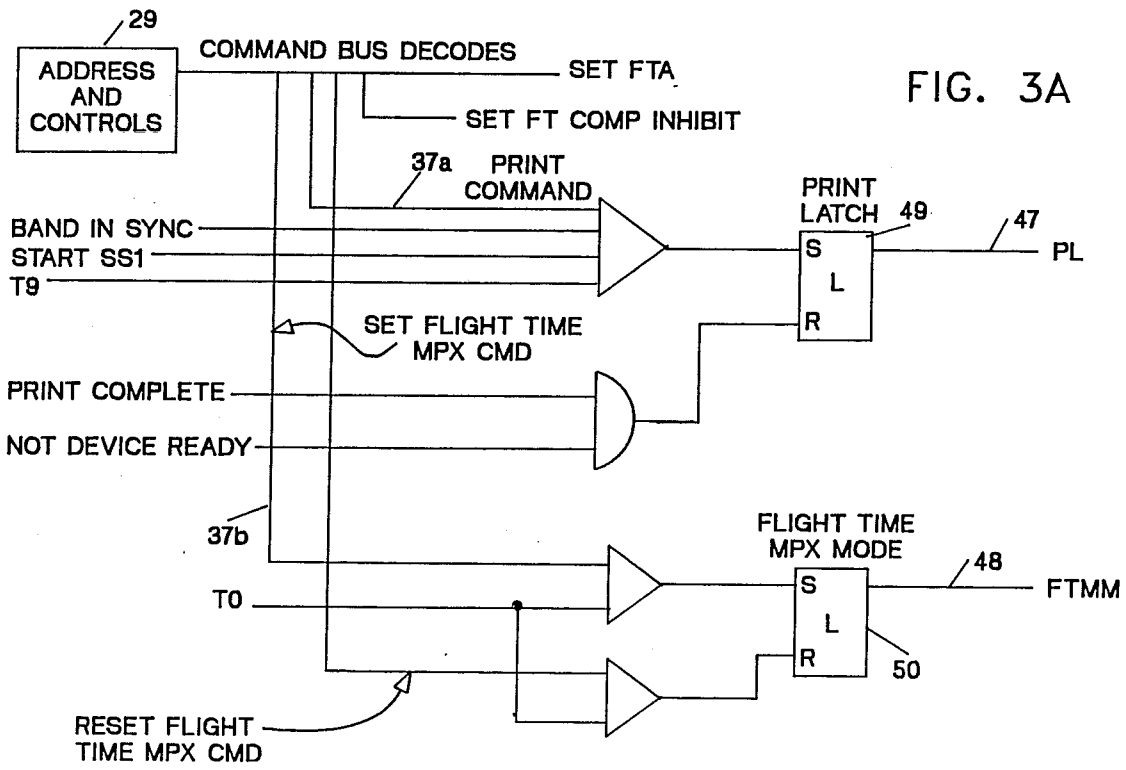
FIGS. 3A and B are a schematic diagram of a portion of the print control used for generating signals used for operating the multiplexor controls portion of FIG. 1.

In accordance with this invention, the enabling of flight timing of print hammers 11 concurrently with printing is practiced using print and flight time multiplexor (PFTM) control 42. Data used for selecting the print hammers to be flight timed is transmitted via bus 28 from data interface 27. Hammer address and control signals of selected hammers 11 is received from address and control 29 on bus 30. Other inputs to PFTM control 42 are clock signals on line 43 and Initiate Fire signals on line 44 from comparator 32 through And circuit 33. Additional input signals to PFTM control 42 are Print Latch (PL) and Flight Time Multiplex Mode (FTMM) on lines 47 and 48 respectively from HFT Control 36. As seen in FIG. 3A, the PL signal on line 47 is produced by print latch 49 in response to a print command signal from address and control 29 on line **37*a* of bus 37. The FTMM signal on line 48 is produced by flight time multiplex (MPX) mode latch 50 in response to a Set flight time MPX command signal from address and control 29 on line 37*b* of command decode bus 37. As will be described hereinafter, PFTM control 42 generates a Flight Time Inhibit (FTI) signal on line 51 to Comparator 32 for temporarily inhibiting comparisons of print and type element data from PLB 23 and BIB 24 in accordance with flight time data supplied from data interface 27 via data bus 28 to PFTM 42**.

Figure 2:
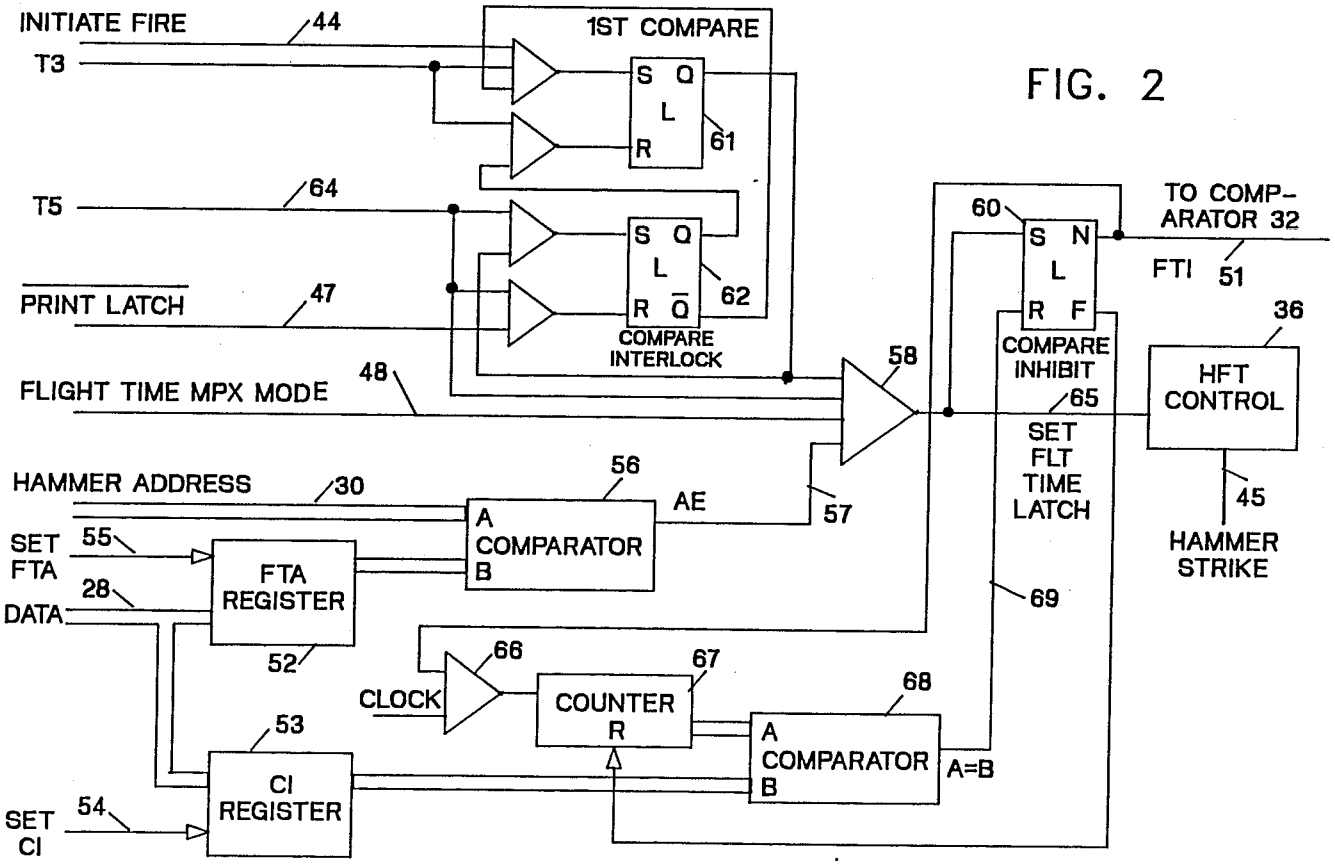
FIG. 2 is logic diagram showing the general arrangement of the flight time multiplexor controls of FIG. 1.

In a preferred embodiment, PFTM control 42, as shown in FIG. 2, comprises a flight time address (FTA) register 52 and a compare inhibit (CI) register 53. A SET compare inhibit signal on line 54 stores inhibit time data supplied on data bus 28 from data interface 27. The inhibit time data may be transmitted to CI register 53 as part of the start up procedure for printing or any time prior to the time when a flight time command signal is applied by address and control 29 to latch 50. The inhibit time data stored in CI register 53, in accordance with this invention, comprises an inhibit time proportional to the flight time of the hammers 11. This Compare Inhibit time is much shorter than the actual hammer flight time and delays the firing of the next hammer long enough to ensure that the Hammer Strike signal on line 45 is indeed the strike signal for the hammer position being measured. The inhibit time may be determined by taking the difference in the flight times of the fastest and the slowest hammers and adding a safety factor. For greater accuracy, however, and especially where the range of flight times among the hammers 11 may be greater, the inhibit time stored in CI register 53 is proportional to the flight time of individual hammers.

A SET FTA signal on line 55 from address and control bus 37 stores the address of the target hammer, i.e. the hammer to be flight timed, appearing on data bus 28 from data interface 27. The address of the target hammer is transmitted to FTA register 52 prior to the transmission of print data to PLB 23. If individual compare inhibit times are used, the compare inhibit time data may be transmitted as part of the same data stream with the print data.

Figure 3B:
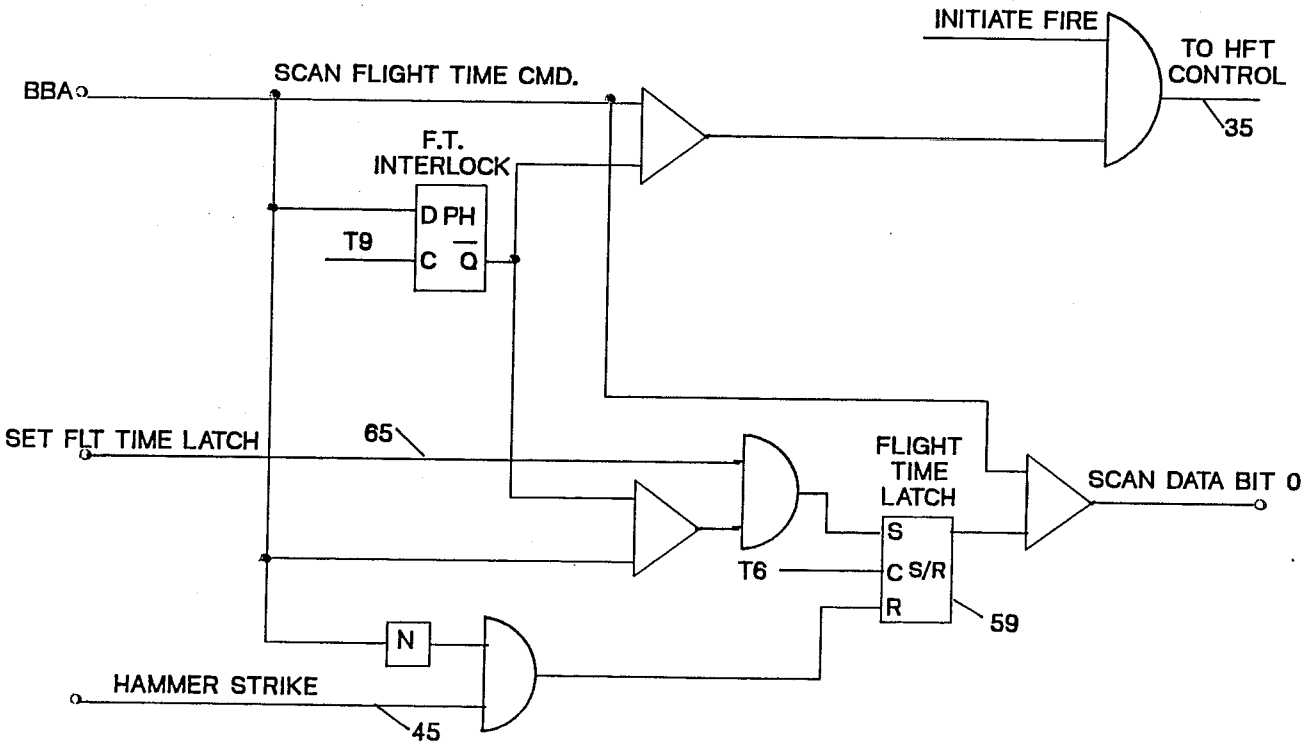

During the printing operation, comparator 56 compares the target hammer address stored in FTA register 52 with hammer address signals on bus 30 being generated in subscan sequence by address and control 29 during reading of data from PLB 23. Coincidentally, data read from PLB 23 is being compared with type element data being read from BIB 24 as previously described (see FIG. 1). When a match of the hammer addresses occurs, comparator 56 generates an address equal (AE) signal on line 57 to AND circuit 58 connected to the set S inputs of compare inhibit latch 60 and flight time latch 59 (see FIG. 3B) which is part of the flight time controls 65. Coincidentally, the first initiate fire signal is applied on line 44 to PFTM controls 42 as a result of matching of the print and type data by comparator 32.

Figure 4:
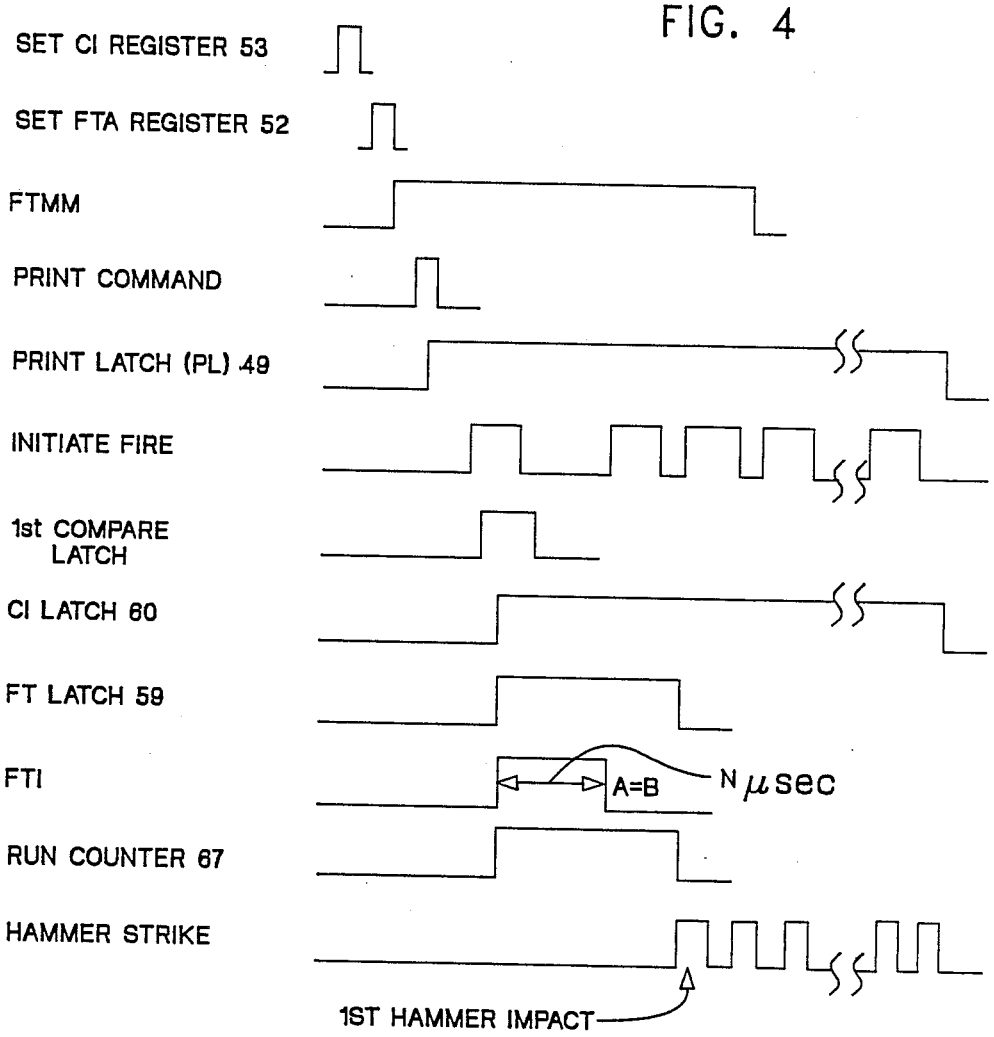
FIG. 4 is chart useful for explaining the operations of the print and flight time multiplexor controls in FIGS. 1–3A and B.

While the target hammer could be one or more of the several hammers operated during a given print operation, the invention preferably is practiced so that only the first hammer selected to be fired in a print operation is selected to be flight timed. Not only does this minimize the effect of flight timing on printing output, but it greatly simplifies the controls for flight timing the target hammer. The target hammer is easily identified prior to printing as part of the processing of data to be printed. For that reason, PFTM control 42 includes first (1st) compare (FC) latch 61 and compare interlock (CI) latch 62. FC latch 61 when switched on, along with a Flight Time Multiplex (MPX) Mode signal on line 63 and a T5 clock pulse on line 64, gates the AE signal from comparator 56 through AND circuit 58 to set FT latch 59 (see FIG. 3B) and compare inhibit latch 60. CI latch 62 in response to the setting of FC latch 61 and a T5 clock pulse on line 64 operates to reset the FC latch 61 and to block subsequent initiate fire pulses from comparator 32 from setting FC latch 61 so long as the print latch 49 remains set. A specific sequence in which the control signals are generated and the latches are set and reset is more clearly understood by reference to FIG. 4.

As previously described, the result of the setting of compare inhibit latch 60 is to apply an FTI signal on line 51 to comparator 32 (see FIG. 1) which temporarily inhibits PLB/BIB comparisons. The result of setting FT latch 59 is to activate flight time measurement controls 36 which may be any well known type designed to measure the time from the setting of the hammer driver circuit which turns on the target hammer until a hammer strike signal is applied to line 45 by the sensor device of platen 16. A result of setting compare inhibit latch 60 is the gating of clock pulses through AND circuit 66 to the inhibit time (IT) counter 67 which was initially set to zero. Comparator 68 compares the count condition of IT counter 67 with the inhibit time stored in register 53. When the two times are equal, comparator 68 applies a signal (A=B) on line 69 to reset compare inhibitor latch 60 to thereby remove the FTI signal from line 51 to comparator 32 (see FIG. 1) and reset inhibit time counter 67. Thus printing of the remaining print data in PLB may continue. Some time later, a hammer strike signal on line 45 resets FT latch 59.

Thus it will be seen that printing can proceed without undue delay. At the same time flight timing of a hammer can take place simultaneously with printing. The same or a different target hammer may be selected in the next print operation. Over a period of time, all the hammers may be flight timed a selected number of times, the new flight times calculated and stored in FTB 25.

While the novel features of the present invention have been shown and described with reference to preferred embodiments thereof, it will be understood by those skilled in the art, that the foregoing and other changes can be made in the form and details without departing from the spirit and scope of the invention.

What is claimed is:

1. In a printer control apparatus for a printer wherein said printer comprises a row of print hammers electrically operable for recording data at a plurality of print positions of a print line, a moving type carrier for continuously presenting type characters at said print positions of said print line, and print control means including hammer selection means for providing selection signals for operating said print hammers to impact said type carrier to effect printing, said selection print including means for repeatedly addressing said print hammers in synchronizaiton with said moving type carrier, said print control means including a hammer flight time control means comprising:

means for indicating a specific address of a hammer to be flight timed, means for comparing addresses generated by said means for addressing said print hammers with said specific address during a print operation, and means responsive to a selection signal generated by said selection means to effect operation of said specific hammer and to a signal from said means for comparing addresses for supplying a signal to said selection means for preventing selection signals for a predetermined interval related to the flight time of the said specific print hammer.

2. In a printer control apparatus in accordance with claim 1 in which said specific address of a hammer to be flight timed is the address of the first hammer selected to be operated in the course of a printing operation.

3. In a printer control apparatus in accordance with claim 1 in which said means for preventing selection signals includes timing means activated by said means for comparing addresses for determining said predetermined interval, and means operable by said timing means upon completion of said interval for enabling the operation of said selection means to effect printing for the remainder of said print operation.

4. In a printer control apparatus in accordance with claim 1 in which said selection means includes means for generating a hammer firing signal to effect printing, and a said means for generating said hammer firing signal is inhibited by said prevention means from generating a second hammer firing signal for said predetermined interval.

5. In a printer control apparatus in accordance with claim 4 in which said means for generating said hammer firing signal includes means for comparing data to be printed by said print hammers with data representing characters on said moving type carrier in synchronization with said addressing of said print hammers, and said means for comparing data is inhibited by said means for preventing selection signals from generating said second hammer firing signal for said predetermined interval.

6. In a printer control apparatus in accordance With claim 3 in which said timing means for determining said predetermined interval includes storage means for storing an elapsed time value related to the flight time of said print hammers, counting means activated by said means for preventing selection signals for counting elapsed time pulses, and means for generating an enable signal to said selection means when said elapsed time reached by said counting means equals said elapsed time value.

7. In a printer control apparatus in accordance with claim 6 in which said elapsed time value comprises the difference between the flight time of the fastest print hammer and the flight time of the slowest hammer.

8. In a printer control apparatus in accordance with claim 7 in which said elapsed time value further includes a safety factor value added to said difference.

9. In printer control apparatus in accordance with claim 6 in which said elapsed time value is varied according the flight time of the selected print hammer.

10. In a printer control apparatus for a line printer wherein said printer comprises a row of print hammers electrically operable for recording data at a plurality of print positions of a print line, a moving type carrier for continuously presenting type characters at said print positions of said print line, and print control means including hammer selection means for providing selection signals for operating a plurality of said print hammer to impact said type carrier to effect printing of a line of print, said print control means including hammer flight time control means comprising means for identifying for flight timing only one of said hammers selected to be operated to effect printing of said line of print, and means responsive to a selection signal by said selection means selecting said one print hammer to effect printing during said printing of said line of print and to said means for identifying said one print hammer identified for flight timing for activating said hammer flight time control means.

11. In a printer control apparatus in accordance with claim 10 in which said one print hammer identified for flight timing by said identifying means is the first hammer selected by said selection means to effect printing of said line of print.

12. In a printer control apparatus in accordance with claim 10 in which said flight time control means includes means for preventing operation of additional print hammers to effect printing for a predetermined interval during said print operation, said predetermined interval being related to the flight time of said specific hammer.

* * * * *